US008939802B2

(12) United States Patent
Hara et al.

(10) Patent No.: US 8,939,802 B2
(45) Date of Patent: Jan. 27, 2015

(54) CONNECTION TERMINAL WITH SPRING PORTIONS

(75) Inventors: Terufumi Hara, Makinohara (JP); Toshinori Sakurai, Fujieda (JP)

(73) Assignee: Yazaki Corporation, Tokyo (JP)

( * ) Notice: Subject to any disclaimer, the term of this patent is extended or adjusted under 35 U.S.C. 154(b) by 109 days.

(21) Appl. No.: 13/813,089

(22) PCT Filed: Jul. 29, 2011

(86) PCT No.: PCT/JP2011/067920

§ 371 (c)(1),
(2), (4) Date: Mar. 4, 2013

(87) PCT Pub. No.: WO2012/015074

PCT Pub. Date: Feb. 2, 2012

(65) Prior Publication Data

US 2013/0157523 A1 Jun. 20, 2013

(30) Foreign Application Priority Data

Jul. 30, 2010 (JP) ..... 2010-172445

(51) Int. Cl.
*H01R 4/18* (2006.01)
*H01R 4/48* (2006.01)
(Continued)

(52) U.S. Cl.
CPC ..... *H01R 4/48* (2013.01); *H01R 13/05* (2013.01); *H01R 13/2428* (2013.01); *H01R 43/16* (2013.01)
USPC ..... 439/867

(58) Field of Classification Search
CPC ..... H01R 4/48; H01R 13/05; H01R 13/2428; H01R 43/16
USPC ..... 439/867, 824, 700, 247, 248
See application file for complete search history.

(56) References Cited

U.S. PATENT DOCUMENTS

| | | | |
|---|---|---|---|
| 6,059,595 | A | 5/2000 | Lacrouts-Cazenave |
| 6,361,379 | B1 | 3/2002 | Ito et al. |

(Continued)

FOREIGN PATENT DOCUMENTS

| | | | |
|---|---|---|---|
| EP | 0766874 | B1 | 3/1999 |
| JP | 10-504676 | A | 5/1998 |
| JP | 2001-155828 | A | 6/2001 |
| JP | 2010-10013 | A | 1/2010 |
| JP | 2010-118257 | A | 5/2010 |
| WO | 2005/065432 | A2 | 7/2005 |

OTHER PUBLICATIONS

International Search Report for PCT/JP2011/067920, dated Nov. 15, 2011 <PCT/ISA/210>.

(Continued)

*Primary Examiner* — Javaid Nasri
(74) *Attorney, Agent, or Firm* — Sughrue Mion, PLLC

(57) ABSTRACT

Provided is a connection terminal 11 including a terminal body 12 and a movable contact 13 having a pair of spring portions 42*a* and 42*b* extending in the same direction from the both sides of a contact tab 43, wherein the end portions of the spring portions 42*a* and 42*b* of the movable contact 13 are fixed to the terminal body 12, the contact tab 43 at the tip end of the movable contact 13 is conductively connected to the other terminal to be connected by being pushed to the terminal, and the movable contact 13 is formed in a process in which a metal plate is blanked to form a pair of spring portions 42*a* and 42*b* having a wavy shape in planar view at both sides of a central portion of the plate which will be the contact tab 43, and the portion of the plate is folded in the same direction as a boundary so that the spring portions 42*a* and 42*b* extend in parallel from the both sides of the contact tab 43 including the portion of the plate.

3 Claims, 5 Drawing Sheets

(51) Int. Cl.

| | |
|---|---|
| ***H01R 13/05*** | (2006.01) |
| ***H01R 13/24*** | (2006.01) |
| *H01R 43/16* | (2006.01) |

(56) References Cited

U.S. PATENT DOCUMENTS

| | | | | |
|---|---|---|---|---|
| 6,739,044 | B2 * | 5/2004 | Abouchar | 29/837 |
| 6,783,405 | B1 | 8/2004 | Yen | |
| 2011/0045713 | A1 | 2/2011 | Ono et al. | |

OTHER PUBLICATIONS

Written Opinion for PCT/JP2011/067920, dated Nov. 15, 2011 <PCT/ISA/237>.

Office Action, Issued by the State Intellectual Property Office of P.R. China, Dated Aug. 20, 2014, In counterpart Chinese Application No. 2011800374930.

Communication from the Japanese Patent Office dated Jun. 24, 2014, in a counterpart Japanese application No. 2010-172445.

* cited by examiner

CONNECTION TERMINAL WITH SPRING PORTIONS

TECHNICAL FIELD

The present invention relates to a connection terminal that is accommodated in a housing so as to configure a connector.

BACKGROUND ART

Generally, a connector has a configuration in which a connection terminal that is connected to an electric wire is accommodated in a housing (see PTL 1, for example).

As shown in FIG. 5, the connection terminal includes a wavy tab 2 integrally provided with a body 1, and a head 3 that is located at the tip end of the wavy tab 2 contacts the head of the other terminal. Also, the wavy tab 2 serves as a spring in this connection terminal and enables connection with excellent contact pressure.

CITATION LIST

Patent Literature

[PTL 1] PCT Japanese Translation Patent Publication No. 10-504676

SUMMARY OF INVENTION

Technical Problem

Incidentally, as shown in FIG. 6, in the connection terminal, a metal plate 4 is blanked to integrally form a portion to be the body 1 and a portion to be the wavy tab 2. Thereafter, the body 1 is formed by performing a bending process, and the portion to be the wavy tab 2 is formed into a wavy shape. Therefore, it is difficult for the portions to be formed with a high dimensional accuracy, which leads to a possibility that the dimensional reliability is low.

Moreover, in the connection terminal, the body 1 is integrally formed with the wavy tab 2. Accordingly, in a case that the dimensional accuracy of the wavy tab 2 is poor, the whole connection terminal becomes a defective product, which leads to a problem of low yield.

The present invention has been made in consideration of the above situation, and an object thereof is to provide a connection terminal with a high connection reliability that can be produced with excellent yield and a high dimensional accuracy.

Solution to Problem

To achieve the above objects, the connection terminal according to the invention has any one of the flowing characteristics (1) to (3).

(1) A connection terminal comprising a terminal body; and a movable contact having a contact tab and a pair of spring portions extended from both sides of the contact tab in a same direction; wherein end portions of the spring portions are fixed to the terminal body, the contact tab of the movable contact is to be pushed to an other terminal to be connected so as to be conductively connected to the other terminal, the movable contact is formed in a process in which a metal plate is blanked to form the pair of spring portions each having a wavy shape in planar view at both sides of a central portion of the plate which is to be the contact tab, and the plate is folded in the same direction as a boundary so that the spring portions are extended in parallel from the both sides of the contact tab.

(2) The connection terminal having the configuration of (1), wherein connection positions of the spring portions in the contact tab are positions of point symmetry with respect to the midpoint of the contact tab.

(3) The connection terminal having the configuration of (1) or (2), wherein the phases of the waves of the wavy spring portions extending from the both sides of the contact tab are opposite to each other.

The connection terminal having the configuration of (1) includes two components of the terminal body and the movable contact, and the movable contact is formed in a process in which a metal plate is blanked to form a pair of the spring portions each having a wavy shape in planar view at both sides of a central portion of the plate which will be the contact tab, and the portion of the plate is folded in the same direction as a boundary so that the spring portions extend in parallel from the both sides of the contact tab. Therefore, it is possible to separately form the terminal body and the movable contact with a high dimensional accuracy.

That is, the metal plate is blanked to integrally form a portion to be the body and a portion to be the wavy tab, and thereafter, the body is formed by the bending process and compared to the connection terminal in which the portion to be the wavy tab is formed into a wavy shape. Therefore, it is possible to form the connection terminal with a high dimensional accuracy and to significantly improve the dimensional reliability. As a result, it is possible to increase the yield and to reduce the production costs.

Furthermore, forming the connection terminal with a high dimensional accuracy makes it possible to improve the positional accuracy of the contact tab with respect to the terminal body and to improve the connection reliability with respect to the other terminal to be connected.

In the connection terminal having the configuration of (2), the connection positions of the spring portions in the contact tab are positions of point symmetry with respect to the midpoint of the contact tab. Accordingly, it is possible to prevent slanting of a contact surface between the contact tab and the other terminal to be connected, which results from torsion or slanting of the movable contact. That is, it is possible to provide a well balanced biasing force from each of the spring portions to the contact tab and to conductively connect the contact tab to the other terminal to be connected with high reliability by excellently and stably pushing the contact tab.

In the connection terminal having the configuration of (3), the phases of the waves of the wavy spring portions extending from the both sides of the contact tab are opposite to each other. Accordingly, it is possible to suppress variations in the biasing force of each spring portion and to conductively connect the contact tab with a higher reliability.

Advantageous Effects of the Invention

According to the invention, it is possible to provide a connection terminal with a high connection reliability which can be produced with excellent yield and a high dimensional accuracy.

The invention has been briefly described as above. Also, by reading through the embodiments of the invention described as follows with reference to accompanying drawings, details of the invention will be further clarified.

BRIEF DESCRIPTION OF THE DRAWINGS

FIG. 4(*a*) is a plan view, and FIG. 4(*b*) is a cross-sectional view taken along the line A-A of FIG. 4(*a*).

DESCRIPTION OF EMBODIMENTS

Hereinafter, an example of the embodiment according to the invention will be described with reference to drawings.

Figure 1:
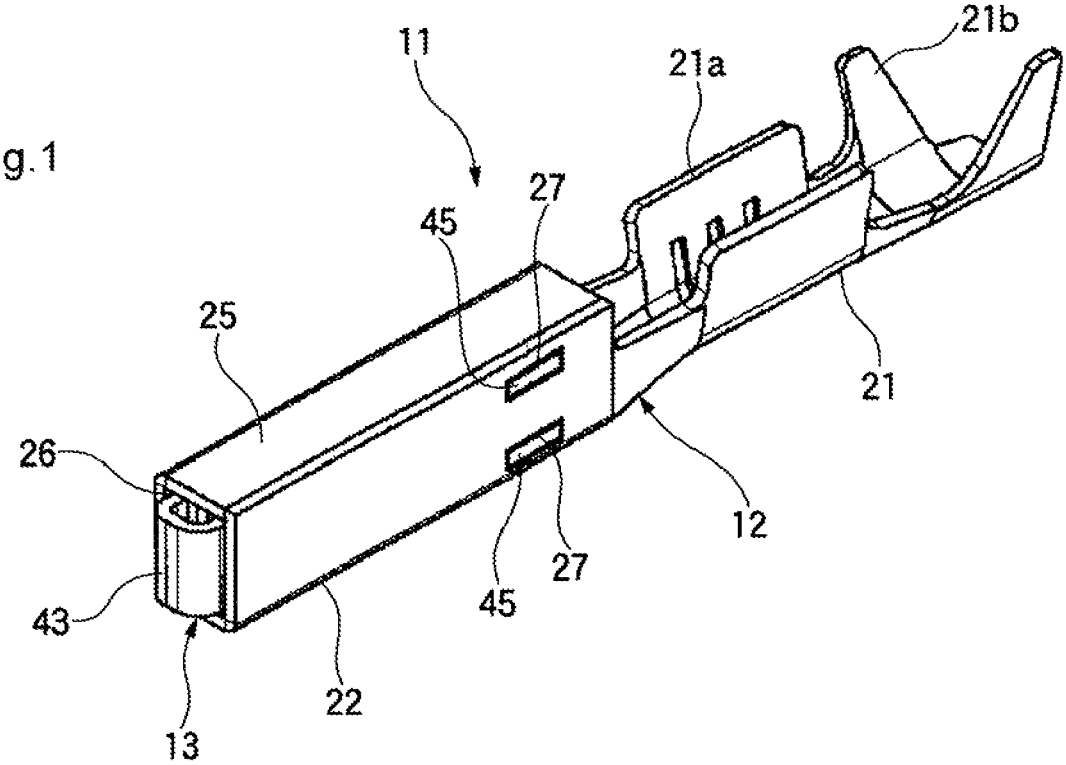
FIG. 1 is a perspective view of a connection terminal according to the embodiment.
Figure 2:
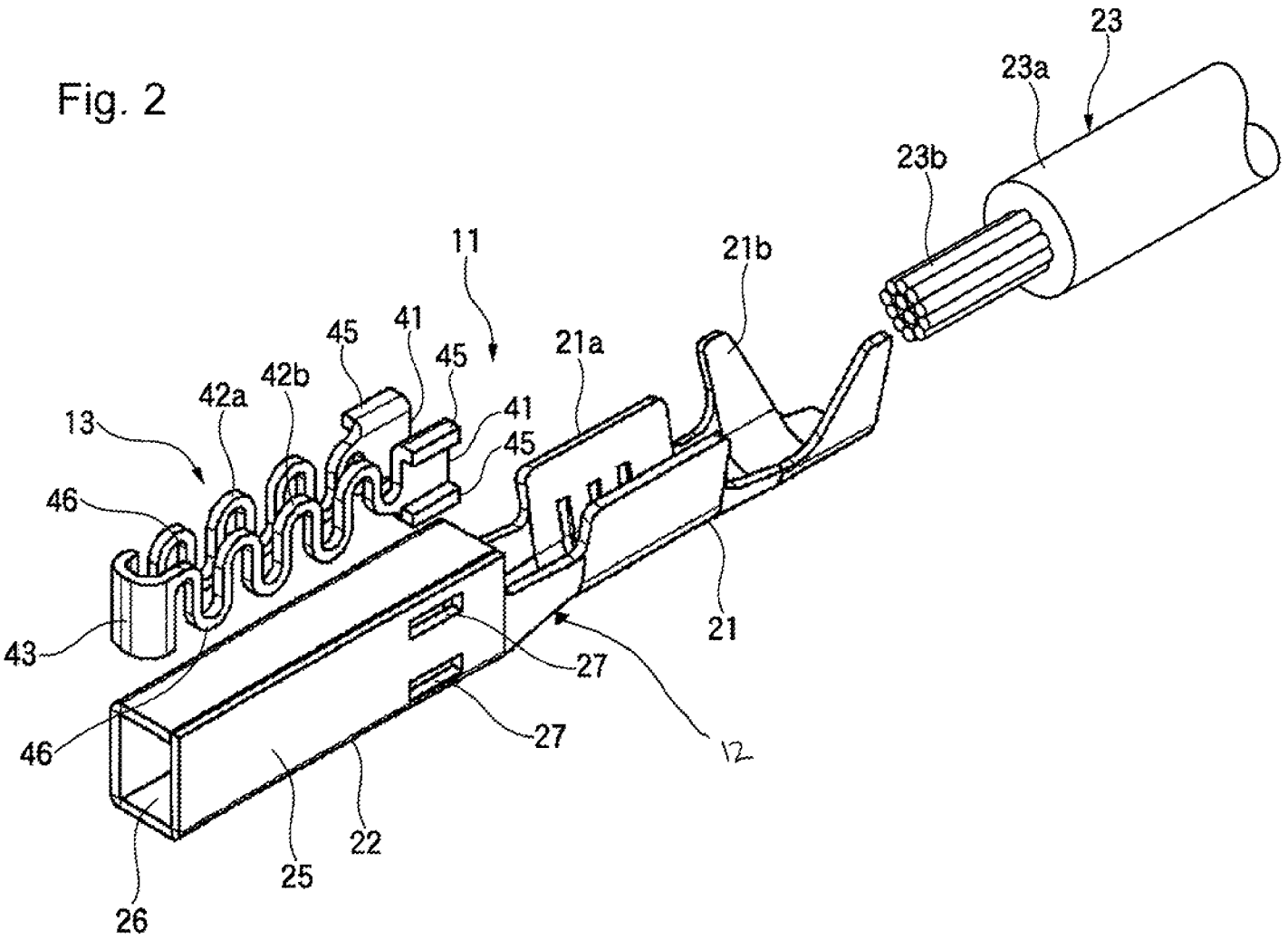
FIG. 2 is an exploded perspective view of the connection terminal according to the embodiment.
Figure 3:
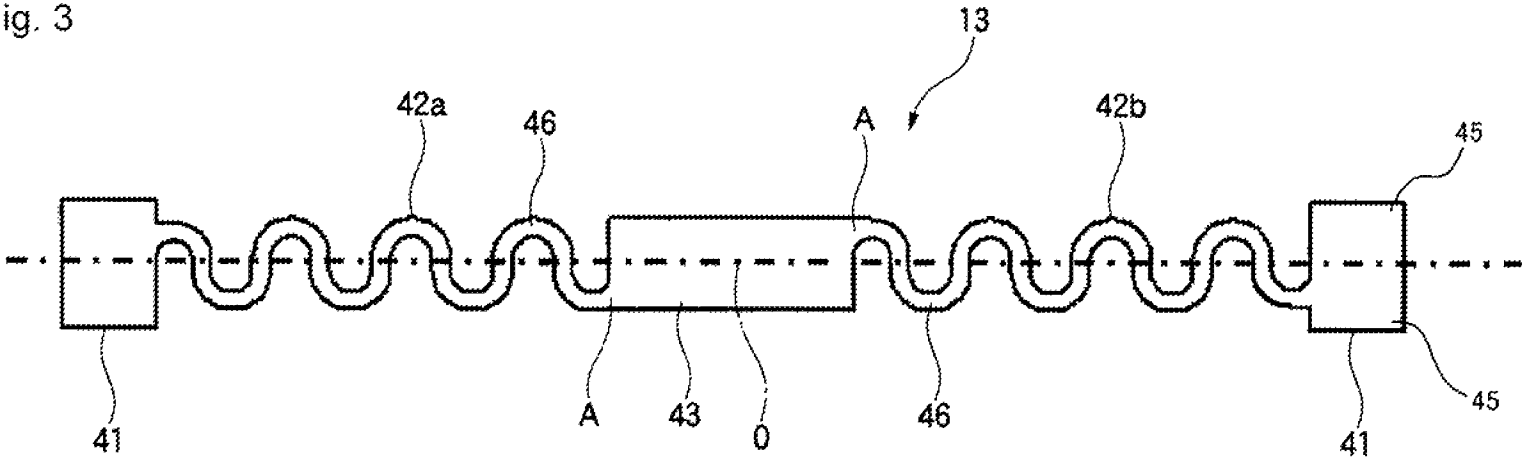
FIG. 3 is a plan view in which a movable contact configuring the connection terminal is spread open.
Figure 4A:
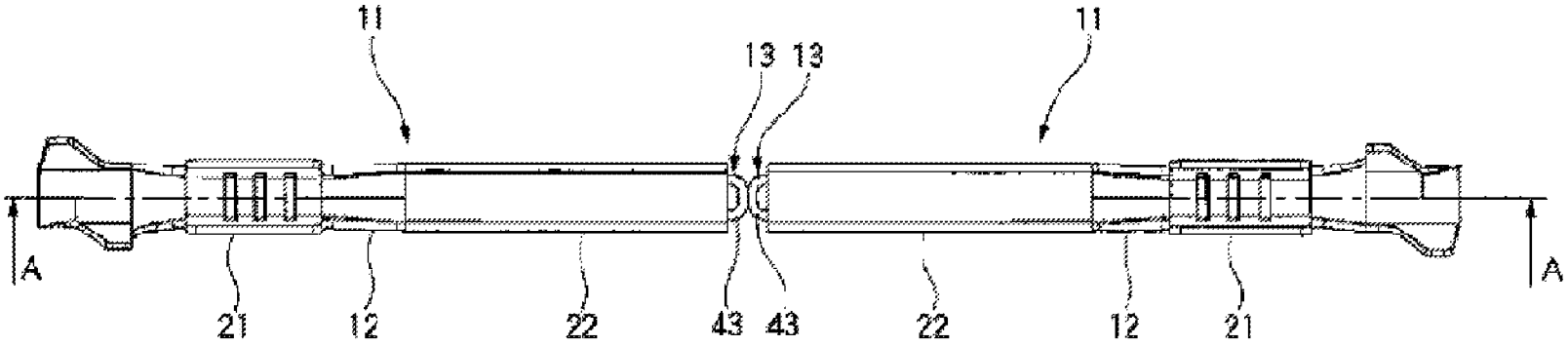
FIGS. 4(*a*) and 4(*b*) are two views illustrating a state of connection between the connection terminals according to the embodiment.
Figure 4B:
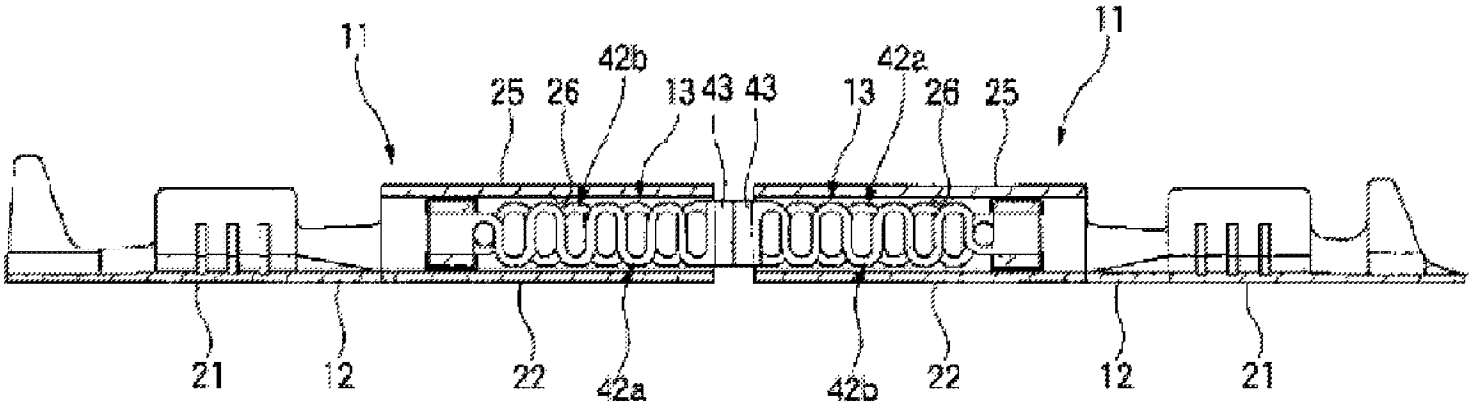
Figure 5:
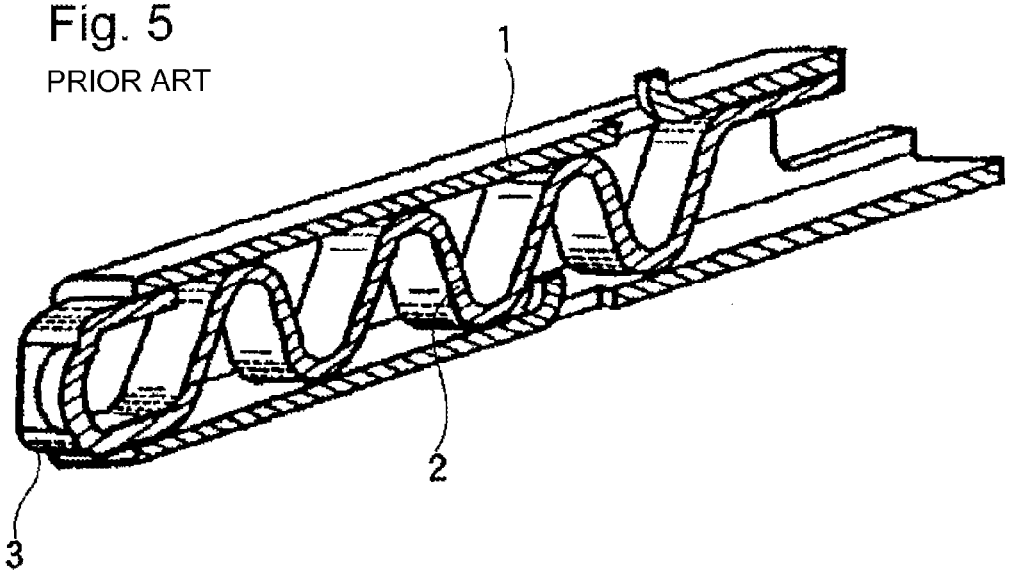
Fig. 5 PRIOR ART
FIG. 5 is a perspective view taken by viewing a cross section of an example of a connection terminal used in the past.
Figure 6:
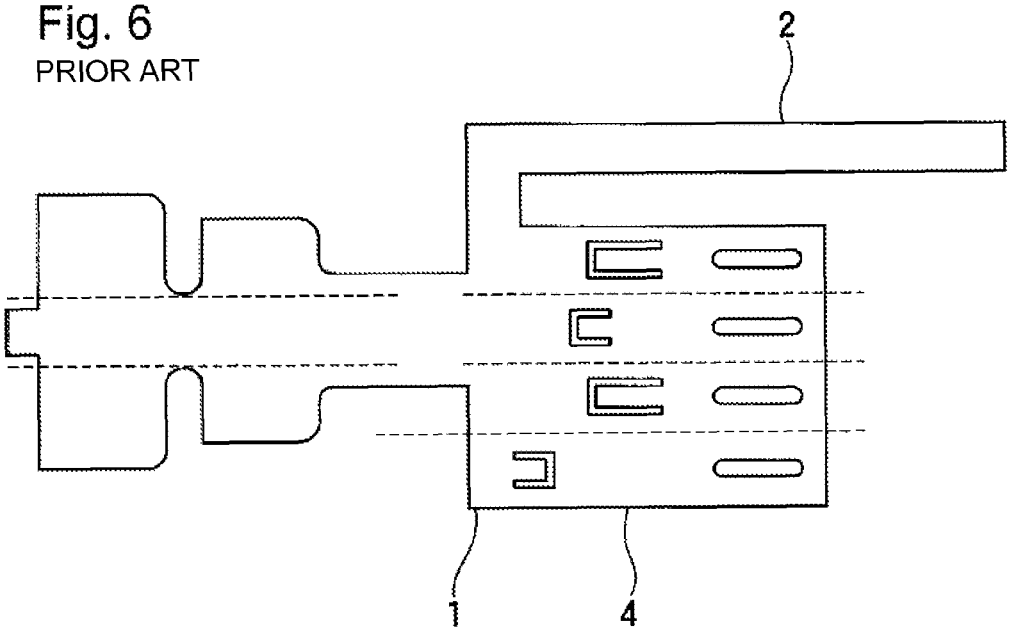
Fig. 6 PRIOR ART
FIG. 6 is a plan view in which an example of the connection terminal used in the past is spread open.

FIG. 1 is a perspective view of a connection terminal according to the embodiment, FIG. 2 is an exploded perspective view of the connection terminal according to the embodiment, FIG. 3 is a plan view in which a movable contact configuring the connection terminal is spread open, and FIG. 4 is a view illustrating a state of connection between the connection terminals according to the embodiment. FIG. 4(*a*) is a plan view, and FIG. 4(*b*) is a cross-sectional view taken along the line A-A of FIG. 4(*a*).

As shown in FIGS. 1 and 2, a connection terminal 11 includes a terminal body 12 and a movable contact 13 that is separate body from the terminal body 12. The connection terminal 11 configures a connector by being accommodated in a housing (not shown). Therefore, when the connectors are connected to each other, movable contacts 13 of the connection terminals 11 are brought into contact with each other.

That is, the connection terminal 11 is not conductively connected in a manner in which a male terminal is fitted and coupled to a female terminal. The connection terminal 11 is conductively connected through contact pressure generated when the movable contacts are bumped into each other.

The terminal body 12 and the movable contact 13 are produced by pressing on a metal plate formed of copper, copper alloy, stainless steel or aluminum. It is preferable to perform tinning on the surface of the metal plate to improve electric connection performance.

In the terminal body 12, the rear end side thereof serves as a crimping portion 21, and the tip end side thereof serves as an electric connection portion 22.

The crimping portion 21 at the rear end side includes a conductor crimping portion 21*a* and a sheath crimping portion 21*b*, and an electric wire 23 is connected to the crimping portion 21 while being crimped.

Specifically, a conductor 23*b* exposed from a sheath 23*a* at the end portion of a electric wire 23 is crimped in the conductor crimping portion 21*a*, and the sheath 23*a* of the electric wire 23 is crimped in the sheath crimping portion 21*b*.

The electric connection portion 22 at the tip end side includes a sliding tube 25 formed into a rectangular tube. The sliding tube 25 includes a sliding hole 26 along the axial direction, which has a rectangular cross section, and the movable contact 13 is accommodated in the sliding hole 26. Also, a pair of engagement holes 27 is formed in each lateral side of the sliding tube 25.

The movable contact 13 accommodated in the sliding tube 25 includes fixing plate portions 41 arranged in parallel to each other, spring portions 42*a* and 42*b* extending toward the tip end side from the fixing plate portions 41 and a contact tab 43 connecting the tip ends of the spring portions 42*a* and 42*b*.

The fixing plate portions 41 include a pair of engagement protrusions 45 protruding outside, and the engagement protrusions 45 engage with the engagement holes 27 formed in the sliding tube 25 from the inside of the sliding tube 25. Accordingly, the rear end of the movable contact 13 is fixed to the sliding tube 25, so the movement of the movable contact 13 in the axial direction is restricted with respect to the sliding tube 25.

The spring portions 42*a* and 42*b* are formed into a linear shape and into a wavy shape having a plurality of curved portions 46 along the axial direction. The phases of the waves of the spring portions 42*a* and 42*b* are opposite to each other when viewed from the lateral side; therefore, each of the curved portions 46 is arranged at mutually differing positions.

The contact tab 43 is curved into a U shape so as to protrude to the tip end side, and the spring portions 42*a* and 42*b* are respectively connected to the both sides of the contact tab 43.

In order to produce the movable contact 13, firstly, a metal plate formed of copper, copper alloy, stainless steel or aluminum is blanked so that the spring portions 42*a* and 42*b* having a wavy shape in planar view are formed between a portion of the plate that is to be the contact tab 43 and the fixing plate portions 41, as shown in FIG. 3.

Herein, connection positions A of the spring portions 42*a* and 42*b* in the contact tab 43 become positions of point symmetry with respect to a midpoint O of the contact tab 43. Furthermore, the wavy spring portions 42*a* and 42*b* are so formed that phases of the waves are opposite to each other.

Then, in the metal plate blanked in the above manner, a portion of the plate to be the contact tab 43 is folded in the same direction as a boundary so that the contact tab 43 is bent into a U shape. As a result, the spring portions 42*a* and 42*b* extend in parallel toward the rear end side of the contact tab 43. Also, the engagement protrusions 45 are formed in the fixing plate portions 41.

When the connectors having the connection terminal 11 in which the movable contact 13 is provided in the terminal body 12 are connected to each other, as shown in FIGS. 4(*a*) and 4(*b*), the contact tabs 43 of the movable contacts 13 of the connection terminals 11 provided in respective connectors abut on each other and are pushed into the sliding holes 26 respectively against the biasing force of the spring portions 42*a* and 42*b*. According to this, the respective contact tabs 43 of the connection terminals 11 are brought into contact with each other by being pushed by the biasing force of the spring portions 42*a* and 42*b*, and extremely excellent conduction is attained through the contact pressure.

Herein, the connection positions A of the spring portions 42*a* and 42*b* in the contact tab 43 are positions of point symmetry with respect to the midpoint O of the contact tab 43. Therefore, torsion or slanting of the movable contact 13 which slides while being pushed to the other terminal to be connected is suppressed as much as possible during the sliding. As a result, the problem of slanting of the contact surface between the contact tab 43 and the other terminal to be connected is resolved.

Moreover, the spring portions 42*a* and 42*b* of the movable contact 13 are formed into a wavy shape in which the phases of the waves are opposite to each other when viewed from the lateral side. Accordingly, the biasing force of the spring portions 42*a* and 42*b* stably acts on the contact tab 43 with good balance.

As described so far, the connection terminal according to the above embodiment includes a terminal body 12 having the sliding hole 26 and the movable contact 13 in which the contact tab 43 at the tip end thereof is conductively connected to the other terminal to be connected while being pushed to the terminal, and the movable contact 13 is formed in a process in which a metal plate is blanked to form a pair of the spring portions 42*a* and 42*b* having a wavy shape in planar view at both sides of a central portion of the plate which will be the contact tab 43, and the portion of the plate is folded in the same direction as a boundary so that the spring portions 42*a* and 42*b* extend in parallel toward the rear end side from the both sides of the contact tab 43. As a result, it is possible to separately form the terminal body 12 and the movable contact 13 with a high dimensional accuracy.

In other words, the metal plate is blanked to integrally form a portion to be the body and a portion to be the wavy tab, and thereafter, the body is formed by bending and compared to the connection terminal in which the portion to be the wavy tab is formed into the wavy shape. Therefore, it is possible to form the connection terminal with a high dimensional accuracy and to significantly improve the dimensional reliability. As a result, it is possible to increase the yield and to reduce the production costs.

Furthermore, forming the connection terminal with a high dimensional accuracy makes it possible to improve the positional accuracy of the contact tab 43 protruding from the sliding hole 26 of the terminal body 12 and to improve the connection reliability with respect to the other terminal to be connected.

Moreover, the connection terminal 11 is not conductively connected in a manner in which a male terminal is fitted and coupled to a female terminal. The connection terminal 11 is conductively connected through contact pressure generated when the connection terminals bump into each other. As a result, it is not necessary to distinguish between the male terminal and the female terminal; accordingly, it is possible to unify components to reduce the number of components and to reduce cost.

In addition, the connection positions A of the spring portions 42*a* and 42*b* in the contact tab 43 are positions of point symmetry with respect to the midpoint O of the contact tab 43. Accordingly, it is possible to prevent slanting of a contact surface between the contact tab 43 and the other terminal to be connected, which results from torsion or slanting of the movable contact 13 at the time of its sliding. That is, it is possible to provide the biasing force from each of the spring portions 42*a* and 42*b* to the contact tab 43 with good balance and to conductively connect the contact tab 43 to the other terminal to be connected with a high reliability by excellently and stably pushing the contact tab.

Furthermore, the phases of the waves of the wavy spring portions 42*a* and 42*b* extending toward the rear end side from the both sides of the contact tab 43 are opposite to each other. Accordingly, it is possible to suppress variations in the biasing force of each of the spring portions 42*a* and 42*b* and to conductively connect the contact tab 43 with a higher reliability.

The invention is not limited to the above embodiment, and modification, improvement or the like can be made appropriately. In addition, the material, shape, dimension, number and arrangement place of each of the constitutional component in the above described embodiment are not limited to the embodiment and can be arbitrarily set as long as they can achieve the invention.

This invention is based on upon and claims the benefit of priority of Japanese Patent Application No. 2010-172445 filed on Jul. 30, 2010, the contents of which are incorporated herein by reference.

REFERENCE SIGN LIST

11: CONNECTION TERMINAL
12: TERMINAL BODY
13: MOVABLE CONTACT
27: ENGAGEMENT HOLES
42*a* and 42*b*: SPRING PORTIONS
43: CONTACT TAB

The invention claimed is:

1. A connection terminal comprising:

a terminal body; and a movable contact, having a contact tab and a pair of spring portions extended from both sides of the contact tab in parallel;

wherein end portions of the spring portions are fixed to the terminal body and are provided with a pair of engagement protrusions which protrude outside the terminal body through a plurality of engagement holes, the contact tab of the movable contact is to be pushed to an other terminal to be connected so as to be conductively connected to the other terminal, the movable contact is formed in a process in which a metal plate is blanked to form the pair of spring portions each having a wavy shape in planar view at both sides of a central portion of the plate which is to be the contact tab, and the plate is folded in the same direction as a boundary so that the spring portions are extended in parallel from the both sides of the contact tab.

2. The connection terminal according to claim 1, wherein connection positions of the spring portions in the contact tab are positions of point symmetry with respect to a midpoint of the contact tab.

3. The connection terminal according to claim 1, wherein a phase of each of the wavy shapes of the spring portions extending from the both sides of the contact tab are opposite to each other.

* * * * *